US007413375B2

(12) United States Patent
Hall

(10) Patent No.: US 7,413,375 B2
(45) Date of Patent: Aug. 19, 2008

(54) APPARATUS AND METHOD FOR HEATING A PAVED SURFACE WITH MICROWAVES

(76) Inventor: David R. Hall, 2185 S. Larsen Pkwy., Provo, UT (US) 84606

( * ) Notice: Subject to any disclaimer, the term of this patent is extended or adjusted under 35 U.S.C. 154(b) by 411 days.

(21) Appl. No.: 11/306,979

(22) Filed: Jan. 18, 2006

(65) Prior Publication Data

US 2006/0198699 A1 Sep. 7, 2006

Related U.S. Application Data

(63) Continuation-in-part of application No. 11/163,615, filed on Oct. 25, 2005, which is a continuation-in-part of application No. 11/070,411, filed on Mar. 1, 2005, now Pat. No. 7,223,049.

(51) Int. Cl.
*E01C 23/14* (2006.01)

(52) U.S. Cl. ..... 404/77; 404/79; 404/95

(58) Field of Classification Search ..... 404/77, 404/79, 90, 95
See application file for complete search history.

(56) References Cited

U.S. PATENT DOCUMENTS

| | | | | |
|---|---|---|---|---|
| 3,361,042 | A | 1/1968 | Cutler | |
| 3,732,023 | A | 5/1973 | Rank | |
| 3,970,404 | A | 7/1976 | Benedetti | |
| 3,989,401 | A | 11/1976 | Moench | |
| 4,018,540 | A | 4/1977 | Jackson | |
| 4,104,736 | A | 8/1978 | Mendenhall | |
| 4,124,325 | A | 11/1978 | Cutler | |
| 4,172,679 | A | 10/1979 | Wirtgen | |
| 4,195,946 | A | 4/1980 | Swisher | |
| 4,252,487 | A | 2/1981 | Jeppson | |
| 4,261,669 | A | 4/1981 | Edo | |
| 4,319,856 | A * | 3/1982 | Jeppson | 404/79 |
| 4,335,975 | A | 6/1982 | Schoelkopf | |
| 4,347,016 | A | 8/1982 | Sindelar | |
| 4,407,605 | A | 10/1983 | Wirtgen | |
| 4,453,856 | A * | 6/1984 | Chiostri et al. | 404/91 |
| 4,473,320 | A | 9/1984 | Register | |
| 4,534,674 | A | 8/1985 | Cutler | |
| 4,560,207 | A | 12/1985 | Eftefield | |
| 4,594,022 | A | 6/1986 | Jeppson | |
| 4,619,550 | A | 10/1986 | Jeppson | |
| 4,668,017 | A | 5/1987 | Petersen | |
| 4,676,689 | A | 6/1987 | Yant | |
| 4,711,600 | A | 12/1987 | Yates | |
| 4,784,518 | A | 11/1988 | Cutler | |
| 4,793,730 | A | 12/1988 | Butch | |
| 4,849,020 | A | 7/1989 | Osborne | |
| 4,850,740 | A * | 7/1989 | Wiley | 404/79 |
| 4,856,202 | A | 8/1989 | Radomsky | |

(Continued)

*Primary Examiner*—Raymond W Addie
(74) *Attorney, Agent, or Firm*—Tyson J. Wilde

(57) ABSTRACT

A system for working a paved surface is disclosed in one aspect of the invention as including a water deposition device for increasing the moisture content of a paved surface; a microwave generator for applying microwaves to the moisture content to heat and thereby soften the paved surface; and a degradation element for working the paved surface. In certain embodiments, the apparatus may also include a surface preparation device to fracture, puncture, mar, scrape, or scarify the paved surface prior to increasing the moisture content, and a containment device to substantially restrict the escape of water as it is deposited onto the paved surface.

15 Claims, 8 Drawing Sheets

U.S. PATENT DOCUMENTS

| | | | | | |
|---|---|---|---|---|---|
| 4,968,101 | A | | 11/1990 | Bossow | |
| 5,092,706 | A | | 3/1992 | Bowen | |
| 5,366,320 | A | | 11/1994 | Hanlon | |
| 5,472,292 | A | * | 12/1995 | Wiley | 404/79 |
| 5,556,225 | A | | 9/1996 | Marino | |
| 5,635,143 | A | | 6/1997 | White | |
| 5,765,926 | A | | 6/1998 | Knapp | |
| 5,791,814 | A | | 8/1998 | Wiley | |
| 6,158,920 | A | | 12/2000 | Malot | |
| 6,190,917 | B1 | | 2/2001 | Barclay | |
| 6,371,689 | B1 | | 4/2002 | Wiley | |
| 6,623,207 | B2 | | 9/2003 | Grubba | |
| 6,769,836 | B2 | | 8/2004 | Lloyd | |
| 7,080,955 | B2 | * | 7/2006 | Gregg | 404/89 |
| 2004/0143653 | A1 | * | 7/2004 | Taylor et al. | 709/223 |
| 2005/0031413 | A1 | * | 2/2005 | Chambard | 404/77 |
| 2006/0078383 | A1 | * | 4/2006 | Novak | 404/79 |

* cited by examiner

APPARATUS AND METHOD FOR HEATING A PAVED SURFACE WITH MICROWAVES

RELATED APPLICATIONS

This Patent application is a continuation-in-part of U.S. patent application Ser. No. 11/163,615 filed on Oct. 25, 2005 and entitled Apparatus, System, and Method for In Situ Pavement Recycling, which is herein incorporated by reference in its entirety. Patent application Ser. No. 11/163,615 is a continuation-in-part of U.S. patent application Ser. No. 11/070,411 filed on Mar. 1, 2005 and entitled Apparatus, System, and Method for Directional Degradation of a Paved Surface, which is herein incorporated by reference in its entirety.

FIELD OF THE INVENTION

The present invention relates to road reconstruction equipment and, more particularly, to systems, apparatus and methods for heating paved surfaces using microwave energy.

BACKGROUND

Asphalt may be the most recycled material in the United States. In fact, tens of millions of tons of asphalt pavement removed each year during highway widening and resurfacing projects is reused as pavement. Such recycling efforts conserve natural resources, decrease construction time, minimize the impact of asphalt plant operations on the environment, and reduce reliance on landfills. Further, research shows that the structural performance of mixtures integrating reclaimed asphalt pavement ("RAP") is equal to, and in some instances better than, virgin asphalt pavement.

Over time, various methods for in-place recycling of asphalt pavement have evolved, including but not limited to hot in-place recycling, cold in-place recycling, and full-depth recycling. These recycling processes generally involve mechanically breaking up a paved surface, applying fresh asphalt or asphalt rejuvenation materials to the pieces, depositing the resulting mixture over a road surface, and compacting the mixture to restore a smooth paved surface. In some cases, broken asphalt may be removed from a road surface, treated off location, and then returned and compacted.

Due to the rigid and abrasive nature of cold asphalt, the hardness of which may approach concrete, heat may be applied to a paved surface prior to milling, grinding, or otherwise working the surface. The heat may be used to soften the asphalt and reduce the wear and tear on asphalt working equipment, as well as reduce the power needed to operate such equipment. Such heat may be applied using direct-flame, radiant, or other suitable types of heaters, which generally rely on the principle of conduction for heat to penetrate the paved surface. Such reliance on conduction generally requires application of heat for long periods of time in order to heat the pavement to sufficient depths. This prolonged exposure generally produces a significant downward temperature gradient in the pavement. Furthermore, the amount of heat that may be applied is severely limited due to the possibility of burning, igniting, or damaging the asphalt.

In order to address some of these problems with conventional heating, some have experimented with microwaves to heat asphalt and other pavement constituents. Rather than relying on conduction, the microwaves penetrate the pavement to excite water or other excitable constituents substantially evenly through the pavement. This enables faster heating of the pavement since constituents at various depths are excited together. Nevertheless, asphalt materials are generally not very responsive to heating by microwave energy. Aggregate materials are typically more responsive to microwave energy and, once heated, may heat the surrounding asphalt materials by conduction.

Nevertheless, like conventional heating methods, microwave energy may also produce a temperature gradient in the paved surface, although the gradient may be reversed and less severe than heating by conduction. That is, microwave energy tends to heat deeper regions of the paved surface more effectively than the surface. This inverted gradient may be due in part to moisture evaporation at the surface in addition to the more rapid cooling that occurs at the surface. This inverted gradient may occur in various types of old and weathered pavement, which may develop a hard dehydrated crust over time due to the evaporation of water or other volatile constituents in the asphalt binder.

To address some or all of the above-stated problems, improved apparatus and methods are needed for heating paved surfaces using microwave energy. More particularly, apparatus and methods are needed to improve the efficiency and uniformity of heat applied to paved surfaces using microwave energy. Further needed are apparatus and methods for restoring moisture to dry and dehydrated pavement to make the pavement more conducive to microwave heating. Further needed are apparatus and methods to remedy the inverted gradient that may occur when using microwaves to heat paved surfaces.

SUMMARY OF THE INVENTION

Consistent with the foregoing, and in accordance with the invention as embodied and broadly described herein, an apparatus for removing a paved surface is disclosed in one aspect of the invention as including a water deposition device for increasing the moisture content of a paved surface; a microwave generator for applying microwaves to the moisture content to heat and thereby soften the paved surface; and a degradation element for working the paved surface.

In selected embodiments, the water deposition device deposits at least one of liquid water, and water vapor onto the paved surface. In other embodiments, the water deposition device forces the water into the paved surface and may deposit water into cracks, holes, fissures, or other voids in the paved surface. Similarly, the water deposition may deposit the water by pouring, flooding, dripping, spraying, misting, injecting, or squirting the water onto the paved surface.

In certain embodiments, the apparatus may include a surface preparation device to fracture, puncture, mar, scrape, or scarify the paved surface prior to increasing its water content. The apparatus may also include a pressurization device to pressurize the water and a heater to heat the water prior to depositing the water onto the paved surface. In selected embodiments, the water deposition device may also include a containment device to substantially restrict the escape of water as it is deposited onto the paved surface.

In another aspect of the invention, a method for working a paved surface is disclosed in one aspect of the present invention as including increasing the moisture content of a paved surface; applying microwaves to the moisture content to heat and thereby soften the paved surface; and working the softened paved surface. In certain embodiments, the step of increasing the moisture content may also include depositing liquid water or water vapor onto the paved surface; forcing the water into the paved surface; depositing the water into cracks, holes, fissures, or voids in the paved surface; and/or pouring, flooding, dripping, spraying, misting, injecting, and squirting the water onto the paved surface.

In selected embodiments, the method may also include fracturing, puncturing, marring, scraping, or scarifying the paved surface prior to increasing its moisture content; and pressurizing and/or heating the water prior to increasing the moisture content of the paved surface. The method may also include focusing the microwaves onto a desired area of the paved surface; and substantially restricting the escape of water as it is deposited onto the paved surface.

In another aspect of the invention, an apparatus for removing a paved surface may include a vehicle to travel across a paved surface; a water deposition device coupled to the vehicle and adapted to increase the moisture content of the paved surface; a microwave generator coupled to the vehicle adjacent to the water deposition device and adapted to apply microwaves to the increased moisture content of the paved surface; and a degradation element coupled to the vehicle and adapted to work the paved surface.

The present invention provides novel apparatus and methods for working a paved surface. The features and advantages of the present invention will become more fully apparent from the following description and appended claims, or may be learned by the practice of the invention as set forth hereinafter.

BRIEF DESCRIPTION OF THE DRAWINGS

In order to describe the manner in which the above-recited features and advantages of the present invention are obtained, a more particular description of apparatus and methods in accordance with the invention will be rendered by reference to specific embodiments thereof, which are illustrated in the appended drawings. Understanding that these drawings depict only typical embodiments of the present invention and are not, therefore, to be considered as limiting the scope of the invention, apparatus and methods in accordance with the present invention will be described and explained with additional specificity and detail through the use of the accompanying drawings in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment in accordance with the present invention. Thus, use of the phrases "in one embodiment," "in an embodiment," and similar language throughout this specification may, but does not necessarily, all refer to the same embodiment.

Furthermore, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

In the following description, numerous specific details are disclosed to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

In this application, "pavement" or "paved surface" refers to any artificial, wear-resistant surface that facilitates vehicular, pedestrian, or other form of traffic. Pavement may include composites containing oil, tar, tarmac, macadam, tarmacadam, asphalt, asphaltum, pitch, bitumen, minerals, rocks, pebbles, gravel, sand, polyester fibers, Portland cement, petrochemical binders, additive or the like. Likewise, rejuvenation materials refer to any of various binders, oils, and resins, including bitumen, asphalt, tar, cement, oil, pitch, additive, wax, or the like. Reference to aggregates refers to rock, crushed rock, gravel, sand, slag, soil, cinders, minerals, or other course materials, and may include both new aggregates and aggregates reclaimed from an existing roadway. Likewise, the term "degrade" or "degradation" is used in this application to mean milling, grinding, cutting, ripping apart, tearing apart, or otherwise taking or pulling apart pavement into smaller constituent pieces.

Figure 1:
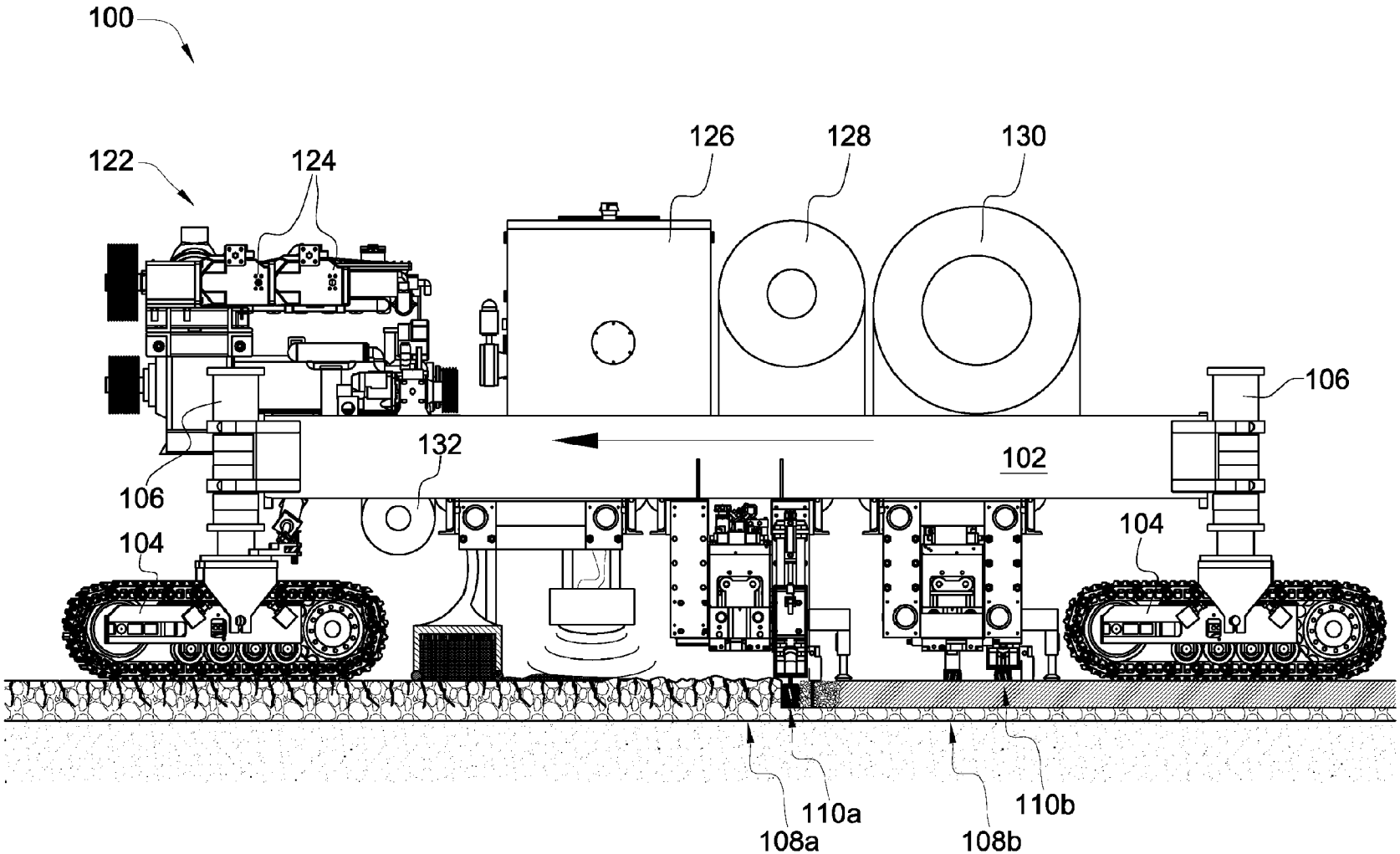
FIG. 1 is a side view illustrating one embodiment of a pavement recycling machine in accordance with the invention.
Figure 2:
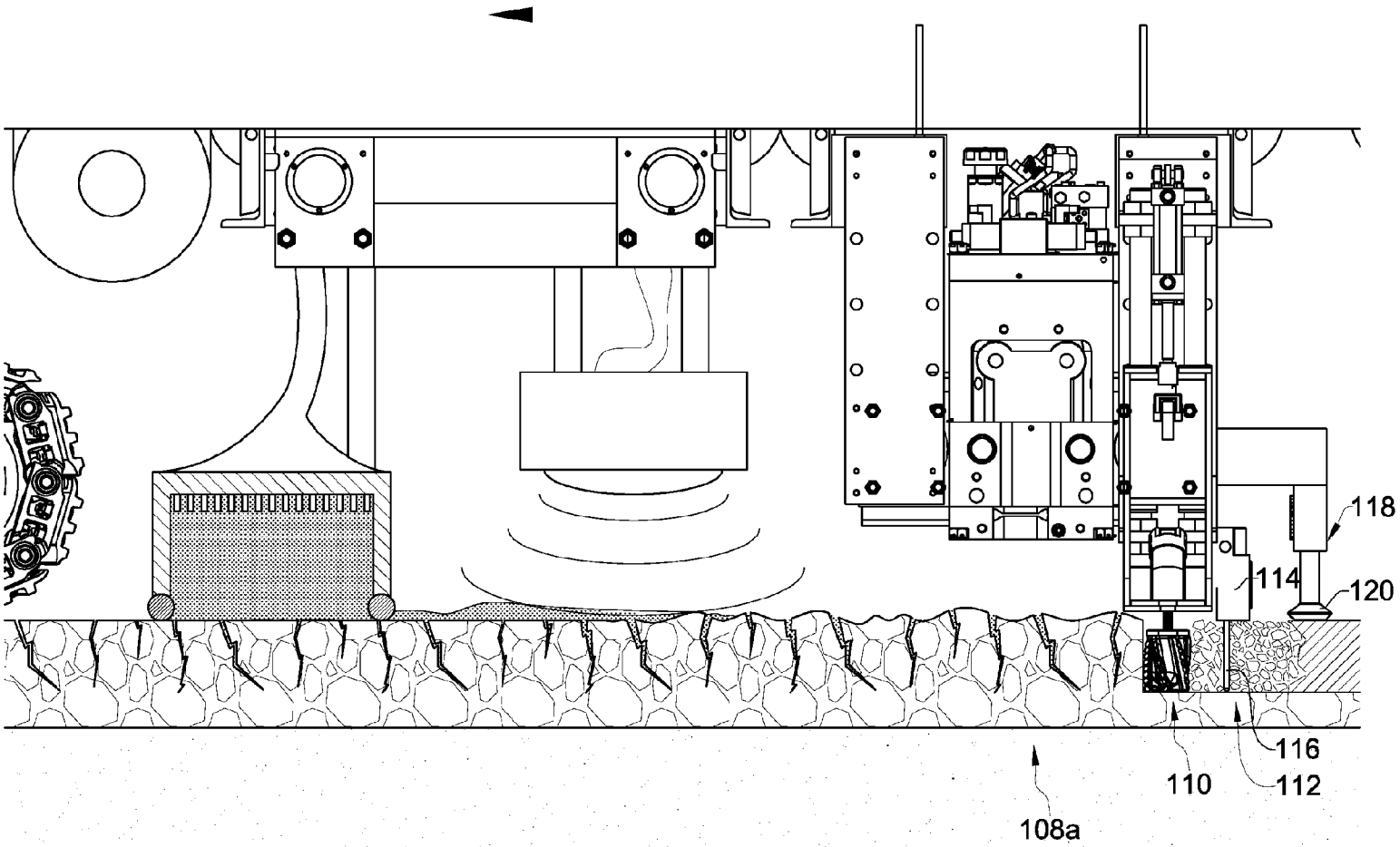
FIG. 2 is an enlarged side view of the undercarriage of the pavement recycling machine illustrated in FIG. 1.

Referring to FIGS. 1 and 2, in selected embodiments, a pavement recycling machine 100 may be adapted to degrade and recycle a section of pavement. The pavement recycling machine 100 may include a shroud (not shown), covering various internal components of the pavement recycling machine 100, a frame 102, and a translation mechanism 104 such as tracks, wheels, to translate or move the machine 100. The pavement recycling machine 100 may also include means 106 for adjusting the elevation and slope of the frame 102 relative to the translation mechanism 104 to adjust for varying elevations, slopes, and contours of the underlying road surface.

In selected embodiments, to facilitate degradation of a swath of pavement wider than the pavement recycling machine 100, the recycling machine 100 may include two or more support assemblies 108*a*, 108*b* that are capable of extending beyond the outer edge of the pavement recycling machine 100. A first support assembly 108*a* may extend to one side of the machine 100 while the other support assembly 108*b* may extend to the other side of the machine 100. Because the support assemblies 108*a*, 108*b* may be as wide as the vehicle itself, the extended support assemblies 108*a*, 108*b* may sweep over a width approximately twice the vehicle width. These assemblies 108*a*, 108*b* may include banks of pavement degradation tools 110*a*, 110*b* that rotate about an axis substantially normal to the plane defined by a paved surface. Each of these pavement degradation tools 110 may be used to degrade a paved surface in a direction substantially normal to their axes of rotation. As shown in FIG. 1, degradation tools 110*a* are working on a near portion of the swath and the degradation tools 110*b* are working a far portion of the swath.

To extend the support assemblies 108*a*, 108*b* beyond the outer edge of the pavement recycling machine 100, each of the support assemblies 108*a*, 108*b* may include actuators, such as hydraulic cylinders, pneumatic cylinders, or other mechanical devices known to those of skill in the art, to move the assemblies 108*a*, 108*b* to each side of the machine 100. Each support assembly 108*a*, 108*b* may also include a rake 112 to level, smooth, and mix pavement aggregates, including new aggregates and reclaimed aggregates generated by the pavement degradation tools 110. As illustrated, a rake 112 may include a housing 114 comprising multiple teeth 116 extending therefrom. In selected embodiments, each of the teeth 116 may be independently extended and retracted relative to the housing 114. This feature may allow selected teeth 116 to be retracted to avoid obstacles such as manholes, grates, or other obstacles in the roadway.

In certain embodiments, each of the teeth 116 may be hollow to accommodate a flow of pavement rejuvenation materials for deposit on a road surface. Pavement rejuvenation materials may include, for example, asphalt, bitumen, tar, oil, water, combinations thereof, or other suitable materials, resins, and binding agents. These rejuvenation materials may be mixed with various aggregates, including new aggregates and reclaimed aggregates generated by the pavement degradation tools 110. The resulting mixture may then be smoothed and compacted to form a recycled road surface. In selected embodiments, the rake 112 may move side-to-side, front-to-back, or vibrate to aid in mixing the resulting mixture of aggregates and rejuvenation materials. Furthermore, in certain embodiments, the bottom of the housing 114 may function as a screed to smooth the resulting mixture of aggregates, binders, and rejuvenation materials. In certain embodiments, each support assembly 108*a*, 108*b* may also include a bank 118 of one or more tampers 120 to compact the recycled road surface. Like the teeth 116, the tampers 120 may be independently extendable and retractable relative to the bank 118.

The pavement recycling machine 100 may include an engine 122 and hydraulic pumps 124 for powering the translation mechanism 104, the support assemblies 108*a*, 108*b*, the pavement degradation tools 110, or other components. Likewise, the pavement recycling machine 100 may include various tanks 126, 128, 130, 132 for storing hydraulic fluid; fuel; rejuvenation materials such as asphalt, bitumen, oil, tar, or the like; water; and aggregates such as gravel, rock, sand, pebbles, macadam, or concrete.

Figure 3:
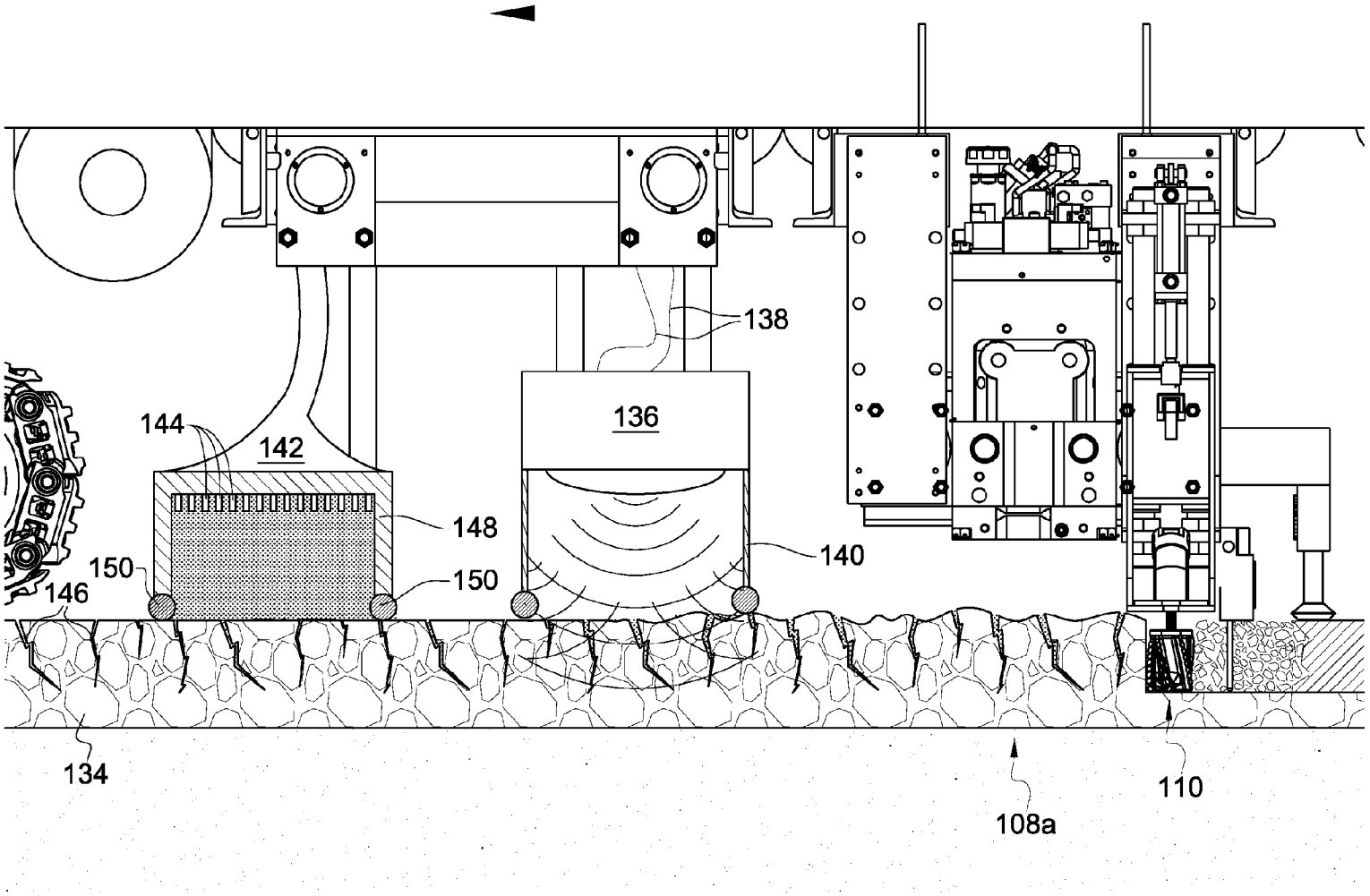
FIG. 3 is a side view of one embodiment of a water deposition device and a microwave generator.

Referring to FIG. 3, heat may be applied to a paved surface 134 prior to degrading the surface with degradation tools 110. This heat may be used to soften the asphalt, thereby extending the life of tools such as the pavement degradation tools 110, and reducing the power needed to rotate the degradation tools 110. The heat may also allow the pavement to be decomposed into smaller constituent pieces without destroying or impairing the aggregate or other constituents in the paved surface 134.

To instantaneously heat the pavement 134 to sufficient depths, and to overcome shortcomings of conventional heaters that heat pavement by conduction, a microwave generator 136 may be coupled to the undercarriage of the pavement degradation machine 100 to apply microwave energy to the paved surface 134. A suitable microwave generator 136 may include, for example, a magnetron, due to its efficiency. A magnetron may convert approximately sixty to seventy percent of its input energy to microwave energy while other microwave generation devices, such as klystrons or solid state generators, may only convert twenty to thirty percent of their input energy into microwave energy. The microwave generator 136 may be powered (by way of wires 138) by a generator or other power source coupled to the pavement degradation machine 100. The microwave generator 136 may also, in certain embodiments, include a guide element 140, such as a waveguide 140, to direct the microwave energy onto a desired area of the paved surface 134 and to prevent power loss.

In certain embodiments, microwaves produced by the generator 136, if supplied with sufficient power, may be helpful in breaking up the pavement 134. For example, various groups have successfully used microwaves to break up concrete into smaller pieces. In doing so, microwaves were used to heat water chemically bound within the concrete. The resulting steam pressure was sufficient to cause the top layer of concrete to break into pieces. Thus, in certain embodiments, the microwave generator 136 may be used to break up or fracture a paved surface 134 ahead of the pavement degradation tools 110.

As previously mentioned, asphalt binders, unlike many aggregates, are often poorly heated by microwave energy. Furthermore, microwave energy may also create an inverted temperature gradient in the paved surface. It is believed that this inverted gradient is caused, at least in part, by the evaporation of moisture at or near the surface of the pavement. This condition may be more pronounced in the surface of old and weathered pavement, which may dry out over time due to the evaporation of water or other volatile constituents in the asphalt binder. Thus, apparatus and methods are needed to restore moisture or compensate for the lack of moisture in dry and weathered pavement to provide more efficient and uniform microwave heating.

To accomplish this task, a water deposition device 142 may be coupled to the undercarriage of the pavement degradation machine 100 to apply water to a paved surface 134. This water may be used to restore or increase the moisture content of the paved surface 134, thereby increasing the responsiveness of the paved surface 134 to microwave heating. Furthermore, because the water deposition device 142 applies water to the surface of the pavement 134, this may compensate for the evaporation of moisture or other volatile constituents at or near the surface. This may also remedy or improve the inverted temperature gradient that may occur when heating the surface 134 with microwaves.

In one embodiment, a water deposition device 142 may include one or more outlets 144, such as jets or nozzles, to discharge water onto the surface 134. As will become apparent from FIGS. 4 through 8, the outlets 144 may apply water to the surface 134 by various methods, including but not limited to pouring, flooding, dripping, spraying, misting, injecting, squirting, or the like. Similarly, the outlets 144 may apply either liquid water, water vapor, or both, to the surface 134. In certain embodiments, the water deposition device 142 may force the water into the paved surface 134. For example, the outlets 144 may discharge water at sufficiently high pressures to force water into voids 146, such as cracks, holes, fissures, or the like, in the paved surface 134. Alternatively, the water may be discharged at high enough pressures to generate voids 146 in the pavement 134 from the impact of the water.

In certain embodiments, water may be heated prior to discharge from the water deposition device 142. This may assist in heating and softening the pavement prior to applying microwaves. In certain embodiments, the heated water may be pressurized to allow the water to be heated significantly beyond its normal boiling temperature.

In certain embodiments, the water deposition device 142 may include a containment device 148 to keep the water contained to a desired area of the pavement 134. This may reduce water usage and prevent water from being deposited on undesired objects or areas. In certain embodiments, the containment device 148 may simply be a shield or screen to minimize or reduce the escape of water. Although an air-tight seal may be difficult to achieve, the containment device 148 may, in selected embodiments, include an interface 150, such as a seal, rollers, or the like, to contact the pavement 134 and prevent, as much as possible, the escape of water. The interface 150 may also be helpful in forcing water into voids 146 in the pavement by preventing the escape of water elsewhere.

In some embodiments of the present invention, more than one vehicle may be used. For example, the water deposition device 142 and the microwave generator 136 may be attached to a first vehicle and the degradation tools 110 may be attached to a second vehicle. In other embodiments, the water deposition device 142 may be applied to a first vehicle and the microwave generator 136 along with the degradation tools 110 may be attached to a second or even third vehicle. It would be obvious to one of ordinary skill to in the art to use as many vehicles as desired.

Figure 4:
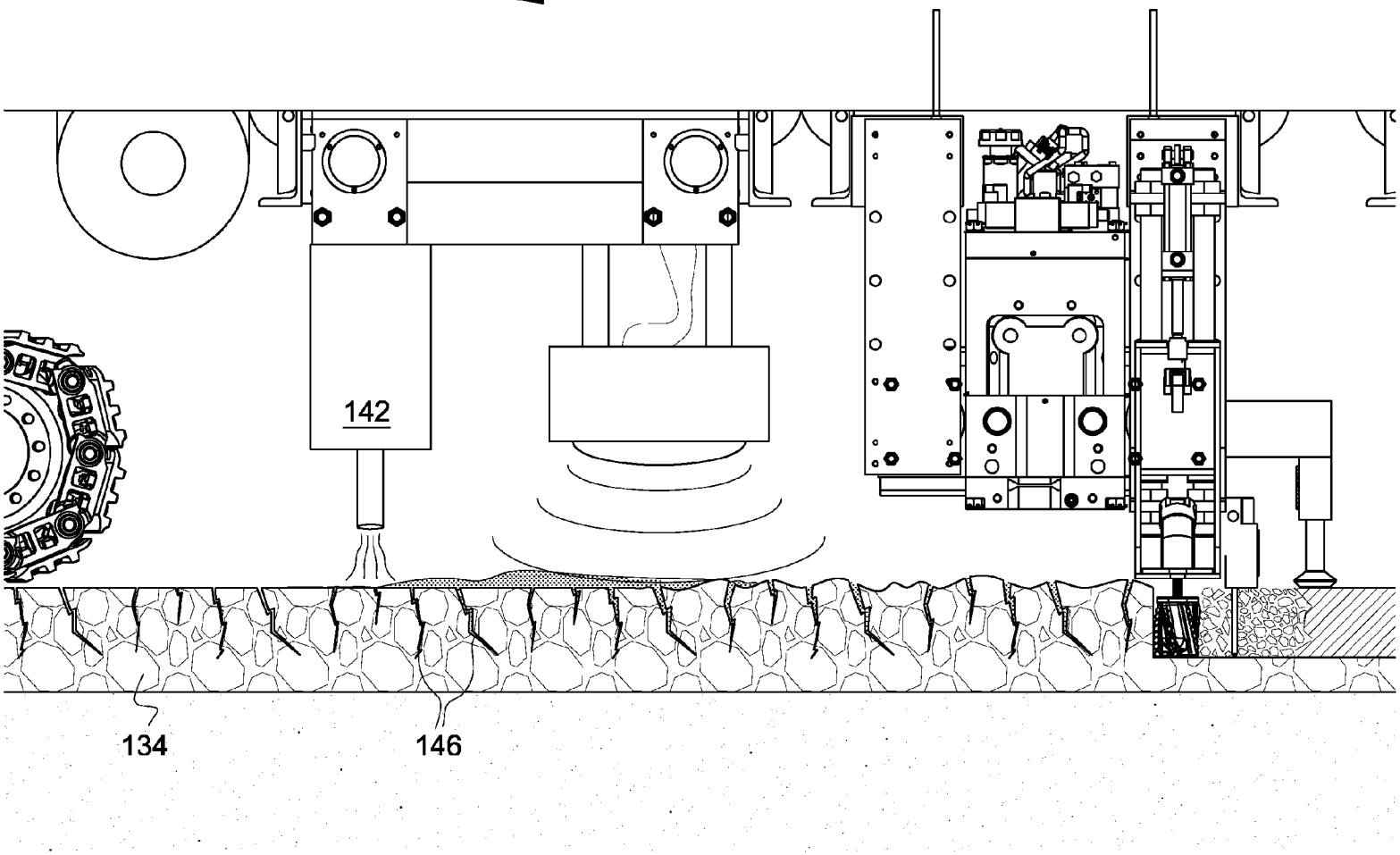
FIG. 4 is a side view of a water deposition device for flooding a paved surface.

Referring to FIG. 4, in certain embodiments, a water deposition device 142 may simply flood the paved surface 134. A "flooding" approach may allow the surface 134 to be completely saturated, thereby allowing water to flow into voids 146, such as cracks or holes, in the pavement 134. Such an approach may primarily rely on gravity to urge water into the voids 146.

Figure 5:
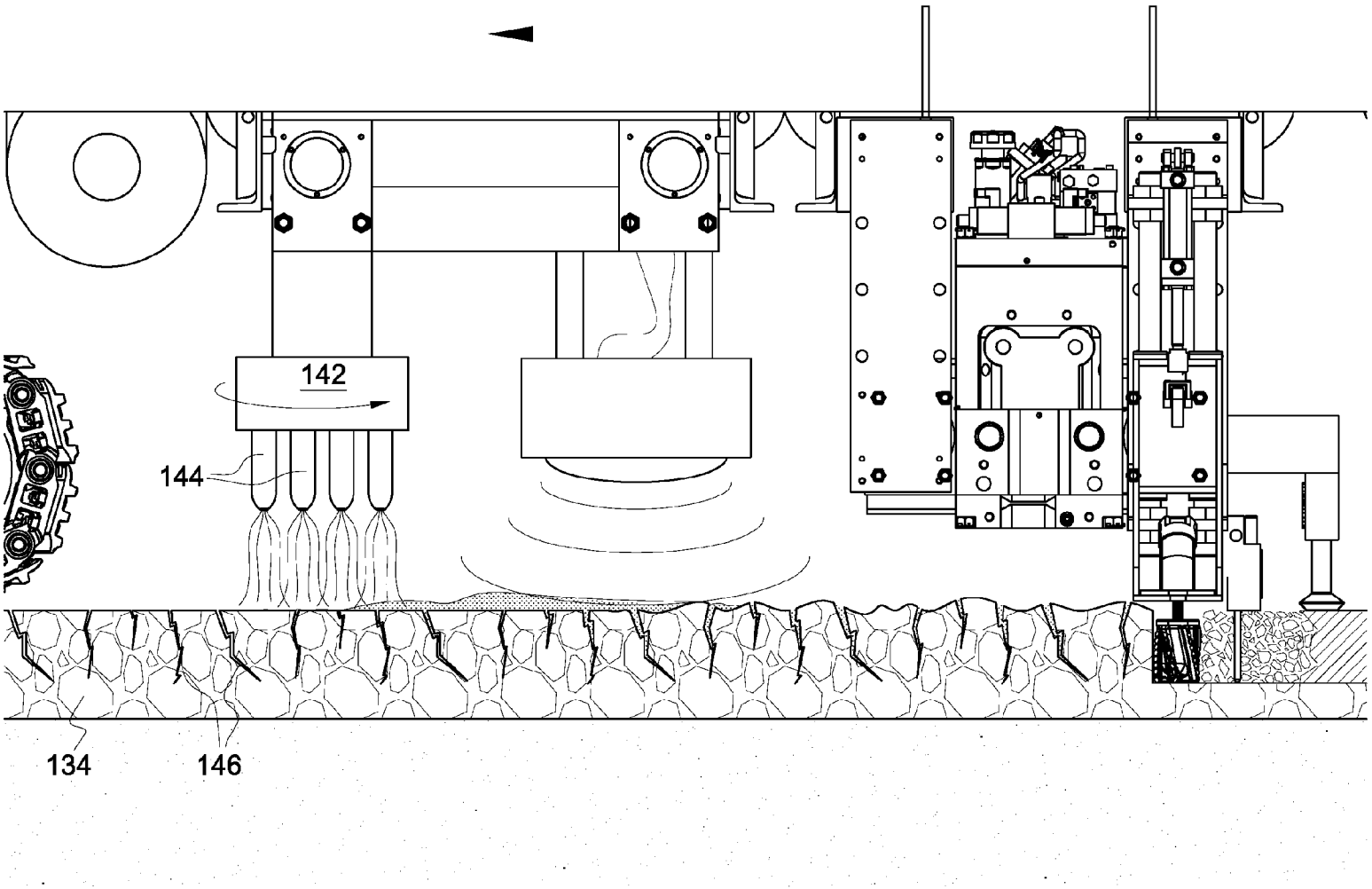
FIG. 5 is a side view of a water deposition device including one or more high-pressure jets or nozzles.

Referring to FIG. 5, in other embodiments, a water deposition device 142 may include one or more high pressure jets 144 or nozzles 144 to spray water toward the paved surface 134. Such an approach may force or impel water into voids 146 in the surface. In certain embodiments, the water may be sprayed with sufficient velocity to dislodge fragments from the surface 134 or fracture the surface 134, thereby infusing the surface 134 with additional moisture. As previously mentioned, the water may also be heated to aid in softening the surface 134. In certain embodiments, the water may be maintained under high pressure to allow the water to be heated significantly beyond its normal boiling point.

Figure 6:
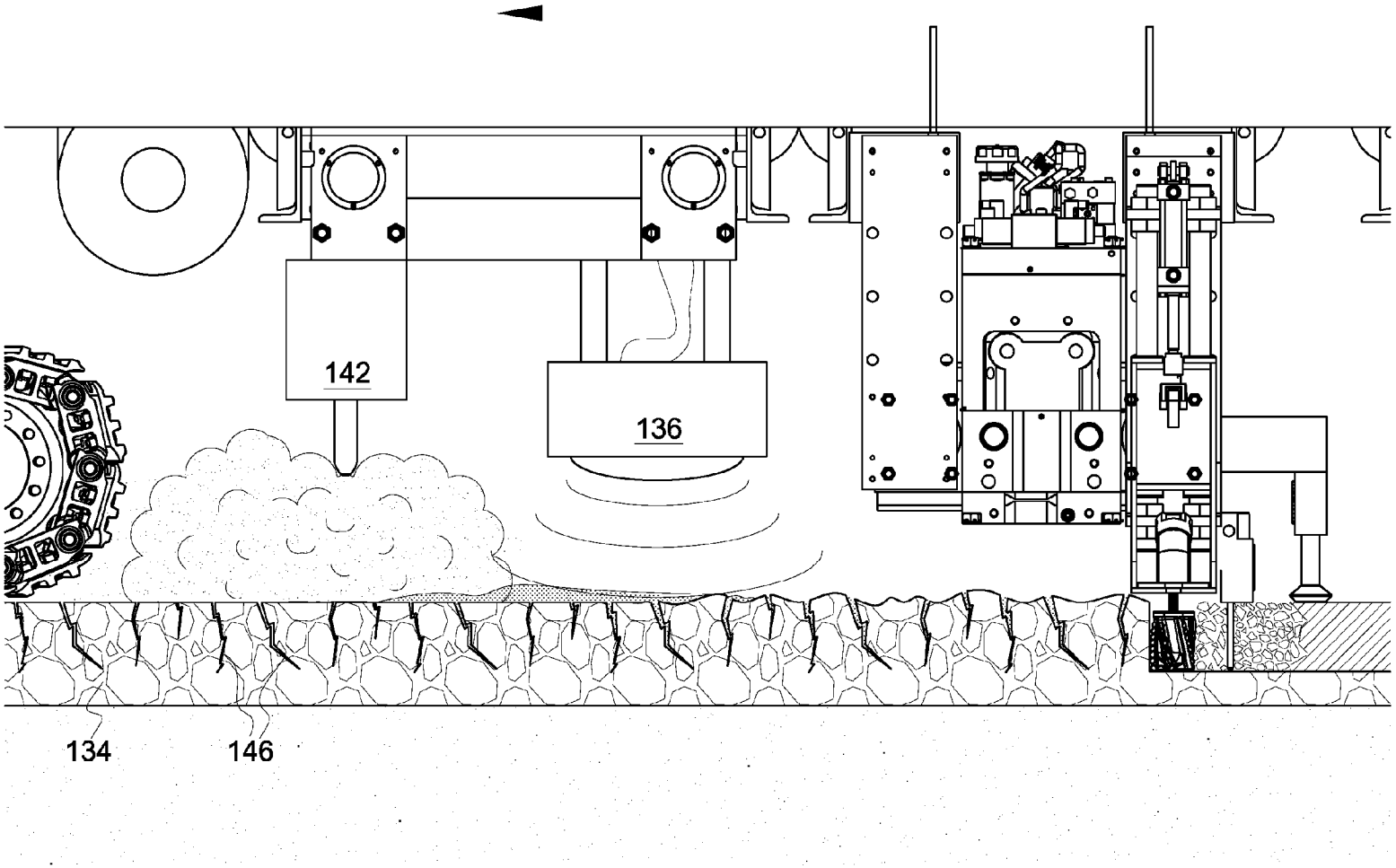
FIG. 6 is a side view of a water deposition device for depositing water vapor or mist onto a paved surface.

Referring to FIG. 6, in other embodiments, a water deposition device 142 may spray water vapor or a water mist onto the paved surface 134. While water vapor generally refers to water in its gaseous state, water mist generally refers to microscopic water droplets suspended in air. In certain embodiments, water vapor may include heated steam directed onto the surface 134. This steam can be much hotter than the boiling point of water, in which case it may be referred to as superheated steam. Heated steam may also serve dual purposes of heating the surface 134 and infusing the surface 134 with moisture to aid heating by the microwave generator 136. As the steam contacts the paved surface 134, the cooler temperatures may cause the steam to condense on the surface 134, thereby depositing water in its liquid state onto the surface 134. This water may then permeate voids 146 in the surface 134. Likewise, water mist may be created by finely spraying water from the deposition device 142, or alternatively, by spraying water vapor which then condenses in the air prior to contacting the paved surface 134.

Figure 7:
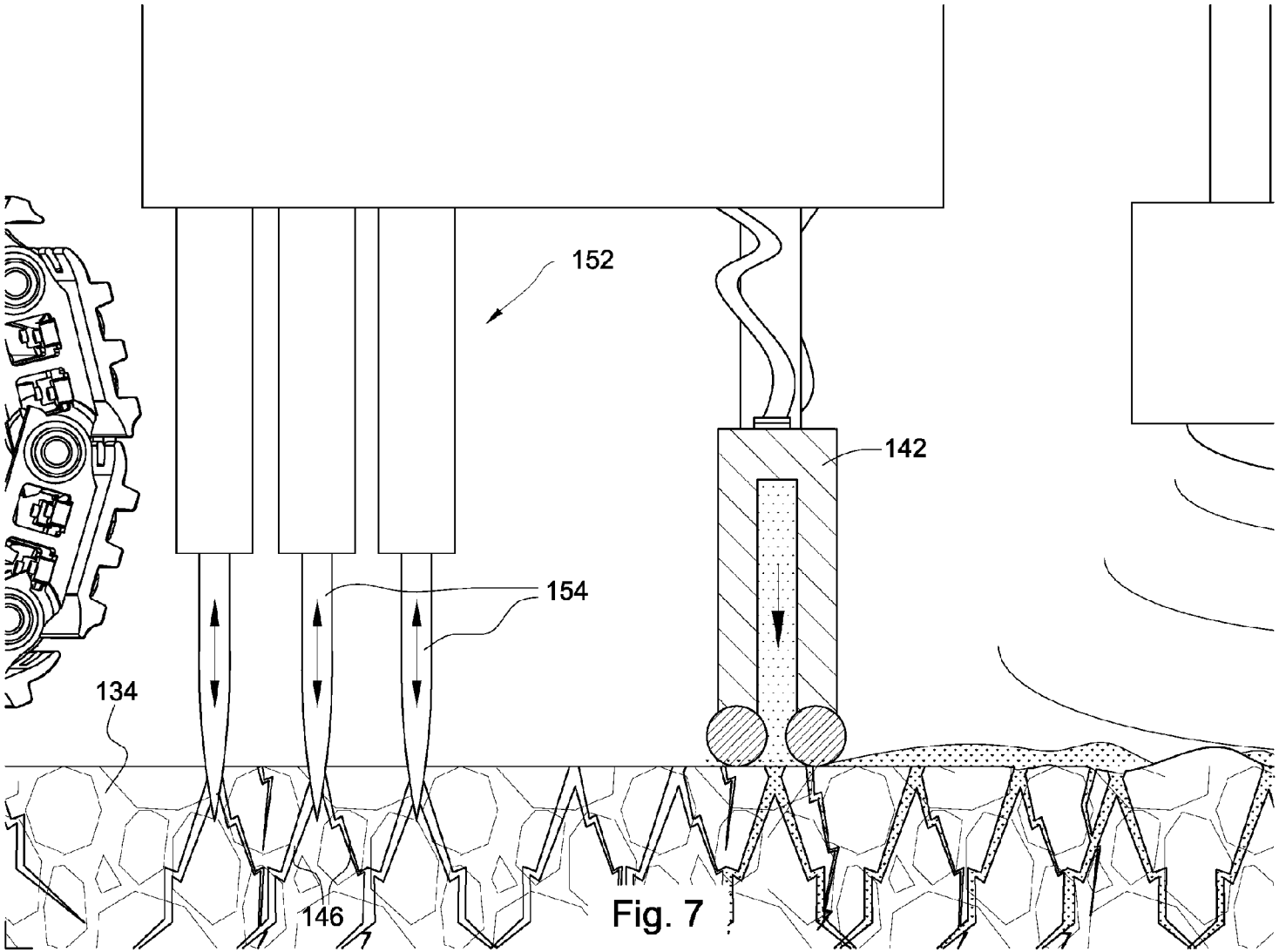
FIG. 7 is a side view of a surface preparation device and a water deposition device in accordance with the invention.

Referring to FIG. 7, in certain embodiments, a surface preparation device 152 may be used to fracture, puncture, mar, scrape, scarify, or the like the paved surface 134 prior to depositing water. This may create additional voids 146 where water may be deposited in addition to increasing the surface area coming in contact with the water. In one embodiment, a surface preparation device 152, as illustrated, may create holes, cracks, or other voids in the surface by thrusting one or more spikes 154 or other tools 154 into the paved surface 134. One of ordinary skill in the art will recognize that a surface preparation device 152 may be embodied in various different forms other than the illustrated embodiment. For example, a surface preparation device 152 may simply be a rake dragged along the pavement to scarify the surface. In other embodiments, a surface preparation device 152 may comprise a roller encircled with spikes or teeth like those illustrated in FIG. 7. Such a roller may be rotated along a paved surface 134 ahead of a water deposition device 142. In yet other embodiments, a surface preparation device 152 may comprise a hammer or other object to fracture the pavement 134 ahead of a water deposition device 142.

Figure 8:
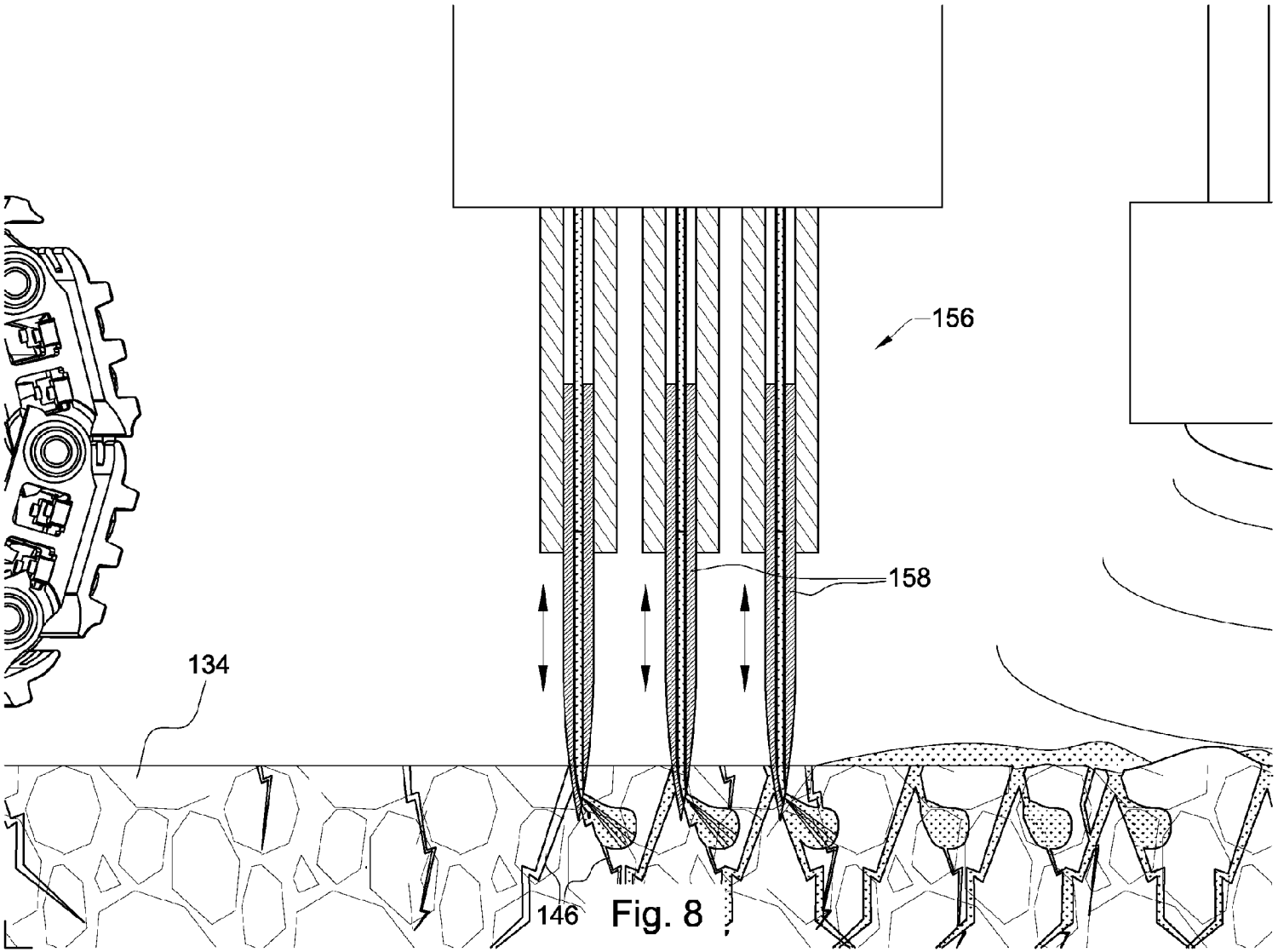
FIG. 8 is a side view of a water deposition device used to inject water into a paved surface.

Referring to FIG. 8, in selected embodiments, water may be injected into a paved surface 134 ahead of the microwave generator 136. For example, one embodiment of an injection device 156 may comprise one or more hollow spikes 158 and be used to penetrate a paved surface 154. These spikes 158 may then inject water into the pavement 134. Such a technique may achieve a deeper level of penetration than could otherwise be achieved by applying water directly to the surface 134. In certain embodiments, the spikes 158 may inject water into existing voids 146 in the pavement. Alternatively, the spikes 158 may inject water at sufficiently high pressure to create or enlarge voids 146 in the pavement 134. Like the previous example, in other embodiments, an injection device 156 may include a roller comprising one or hollow spikes or teeth to be rotated along a paved surface 134.

It is believed that in some embodiments, the paved surface may have an optimal moisture content for heating and then working the paved surface. If there is not enough moisture, the microwaves may have little effect on the paved surface. On the other hand, if there is too much moisture in the paved surface, the moisture may interfere with in situ repaving. Accordingly, it may be beneficial to pre-determine the desired moisture content. Factors that may contribute to moisture content of the paved surface may include weather, humidity, temperature, type of aggregate, and condition of the paved surface. In embodiments where the fragments of the paved surface may be removed before repaving; the moisture may evaporate from the road bed before repaving occurs.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed is:

1. A method for working a paved surface, the method comprising:

increasing a moisture content in a paved surface by injecting pressurized water into the paved surface;

heating the paved surface by applying microwaves to the moisture content and thereby softening the paved surface; and working the softened paved surface with a pavement degradation tool.

2. The method of claim 1, wherein increasing the moisture content further comprises depositing the water into at least one of cracks, holes, fissures, and voids in the paved surface.

3. The method of claim 1, further comprising at least one of fracturing, puncturing, marring, scraping, and scarifying the paved surface prior to increasing the moisture content.

4. The method of claim 1, further comprising pressurizing the water prior to increasing the moisture content.

5. The method of claim 1, further comprising heating water prior to increasing the moisture content of the paved surface.

6. The method of claim 1, wherein heating the paved surface further comprises focusing the microwaves onto a desired area of the paved surface.

7. The method of claim 1, wherein increasing the moisture content further comprises substantially restricting the escape of water as it is directed to the paved surface.

8. A system for working a paved surface, the system comprising:

a water injection device for increasing the moisture content of the paved surface;

a microwave generator for applying microwaves to the moisture content of the paved surface to heat and thereby soften the paved surface; and a degradation element for working the paved surface;

the water injection device and microwave generator being positioned on the underside of a vehicle and the injection device being positioned before the generator.

9. The apparatus of claim 8, wherein the water injection device injects at least one of liquid water, and water vapor into the paved surface.

10. The apparatus of claim 8, wherein the water injection device injects the water into at least one of cracks, holes, fissures, and voids in the paved surface.

11. The apparatus of claim 8, further comprising a surface preparation device to at least one of fracture, puncture, mar, scrape, and scarify the paved surface prior to increasing the moisture content of the paved surface.

12. The apparatus of claim 8, further comprising a pressurization device to pressurize the water prior to increasing the moisture content of the paved surface.

13. The apparatus of claim 8, further comprising a heater to heat the water prior to increasing the moisture content of the paved surface.

14. The apparatus of claim 8, wherein the water injection device further comprises a containment device to substantially restrict the escape of water as it is injected onto the paved surface.

15. An apparatus for working a paved surface, the apparatus comprising:

a vehicle to travel across a paved surface;

a water injection device coupled to the vehicle, the water injection device adapted to increase the moisture content of the paved surface;

a microwave generator coupled to the vehicle adjacent to and before the water injection device, the microwave generator adapted to apply microwaves to the moisture content; and a degradation element coupled to the vehicle and adapted to work the paved surface.

* * * * *